United States Patent [19]

Miyazaki et al.

[11] 4,224,778

[45] Sep. 30, 1980

[54] DEVICE FOR SETTING QUANTITY OF PACKAGING PAPER FEED IN A COIN PACKAGING MACHINE

[75] Inventors: Yorizo Miyazaki; Hideshi Sentoku; Katusuke Furuya, all of Tokyo, Japan

[73] Assignee: Laurel Bank Machine Co., Ltd., Tokyo, Japan

[21] Appl. No.: 18,272

[22] Filed: Mar. 7, 1979

[30] Foreign Application Priority Data

Mar. 13, 1978 [JP] Japan ..... 53/28403

[51] Int. Cl.[3] ..... B65B 57/02; B65B 11/04

[52] U.S. Cl. ..... 53/64; 53/212

[58] Field of Search ..... 53/508, 64, 66, 212

[56] References Cited

U.S. PATENT DOCUMENTS

| | | | |
|---|---|---|---|
| 3,350,835 | 11/1967 | Becker | 53/66 |
| 3,821,917 | 7/1974 | Hatanaka | 53/212 X |
| 4,047,361 | 9/1977 | Ono et al. | 53/212 |
| 4,058,954 | 11/1977 | Asami | 53/212 X |

*Primary Examiner*—Travis S. McGehee
*Attorney, Agent, or Firm*—Fleit & Jacobson

[57] ABSTRACT

A coin packaging machine in which different kinds of coins are packaged. The coin packaging machine is provided with means for supplying coins, means for transporting the supplied coins while selecting a kind of coins out during transportation, means for accumulating transported coins, delivery means for receiving accumulated coins and delivering the coins from receiving position to packaging position, means for supplying a web of paper within packaging zone and means for clamping the packaged coins. The coin packaging machine further includes means for making adjustments of various kinds of the above means in accordance with the thickness and the width of the coins to be packaged. The coin packaging machine is also provided with a quantity of packaging paper feed setting device in which the quantity of packaging paper feed is automatically determined in accordance with the diameter of the coins to be packaged.

4 Claims, 2 Drawing Figures

DEVICE FOR SETTING QUANTITY OF PACKAGING PAPER FEED IN A COIN PACKAGING MACHINE

BACKGROUND OF THE INVENTION

This invention relates to a coin packaging machine, more particularly to a device for setting the quantity of packaging paper feed for use in a coin packaging machine in which a predetermined number of accumulated or stacked coins is packaged or wrapped in packaging paper, a suitable quantity of the packaging paper is then cut, and the upper and lower edges of the packaging paper are inwardly bent or folded by clamping claws.

No device has heretofore been proposed for setting the quantity of packaging paper feed by which the quantity of packaging paper feed is automatically determined in accordance with the diameter of the coins to be packaged to obtain the length of the packaging paper most suitable for a single packaging operation.

SUMMARY OF THE INVENTION

It is, therefore, an object of the invention to provide a device for setting the quantity of packaging paper feed for use in a coin packaging machine by which a quantity of packaging paper suitable for a single packaging operation is determined in accordance with the diameter of the kind of coin selected for packaging, thereby eliminating the excessive or deficient supply of packaging paper.

It is another object of the invention to provide a device for setting the quantity of packaging paper feed of the above type by which the quantity of packaging paper selected for a single packaging operation is such as to provide a roll of packaged coins sufficiently strong to withstand handling and transportation but easy to break open for removal of the coins.

In accordance with the present invention there is provided a device for setting the quantity of packaging paper feed in a coin packaging machine which comprises a group of coin kind selection switches issuing a coded coin kind selecting signal in accordance with the coin kind set by the coin kind setting operation for the coin to be packaged and in which said group of coin kind selection switches is connected through a decoder to a diode matrix, whereby the quantity of packaging paper feed is automatically determined in accordance with the diameter of the coin to be packaged.

Particularly, in the device for setting the quantity of packaging paper feed according to the present invention, the quantity of packaging paper feed is automatically determined by varying the operation time of a driving clutch for driving a paper feeding roller to feed the packaging paper out or by varying the speed of rotation of the paper feeding roller.

DESCRIPTION OF THE DRAWINGS

Other objects and advantages of the present invention will become apparent from the following description made with reference to the accompanying drawings, in which.

DESCRIPTION OF THE PREFERRED EMBODIMENT

One embodiment of the present invention will be now described in detail with reference to the accompanying drawings.

Figure 1:
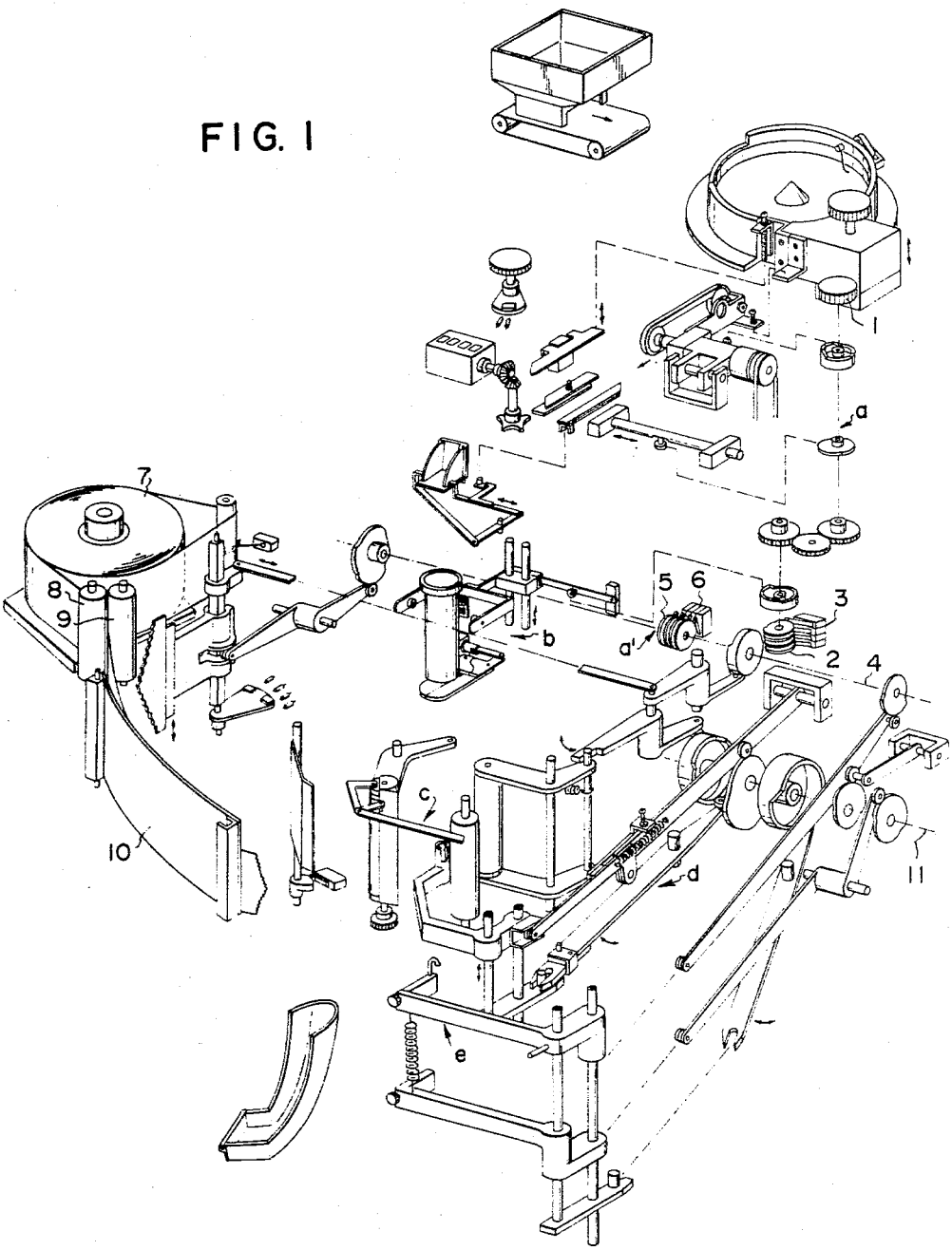
FIG. 1 is a fragmentary perspective view showing the entire structure of the coin packaging machine.

FIG. 1 shows the construction of the coin packaging machine to which the present invention relates. As, however, the details of this machine have been described in Japanese Patent Appliciation No. 96417/77 filed by the same applicant as that of the present application, only the main portions related to the present invention will now be described and the other portions not related to the present invention will be omitted.

When a coin kind setting member 1 is manually operated, various adjusting members at a coin kind setting mechanism operatively associated with the coin kind setting member 1 are actuated to set a coin passage, to set a light sensing device at an irregularity detecting mechanism b for detecting any irregularity in the coins accumulated in an accumulating cylinder, to rotate selection switch cams 2, etc. Provided opposite to the selection switch cams 2 are selection switches 3 which are operatively associated with the selection switch cams 2. Therefore, when the coin kind setting member 1 is operated to select the desired kind of the coin, the setting is made through a combination of contacts of the selection switches 3 obtained by the selection switch cams 2. Then, when a start button is depressed, a setting shaft 4 is rotated by a setting motor, (not shown). The setting shaft 4 has setting switch cams 5 at an adjusting mechanism a'. Provided opposite to the setting switch cams 5 are setting switches 6 which are operatively associated with the setting switch cams 5. A combination of contacts of the setting switches 6 is obtained through the setting switch cams 5 by rotation of the setting shaft 4. When the combination of contacts of the setting switches 6 is coincident with the abovementioned combination of contacts of the selection switches 3, the rotation of the setting motor is stopped and, therefore, the setting shaft 4 is stopped in a predetermined angular position corresponding to the desired kind of coin. Further, by various adjusting members at the setting mechanism, an initial position setting of an upper clamping arm at a clamping mechanism e, a position setting of each packaging roller at a packaging mechanism c, a vertical position setting of a cutter for cutting a packaging paper 7, etc. are made.

Although one feature of the invention described in the above-mentioned Japanese Patent Application No. 96417/77 is directed to the mechanism in which the desired length of the packaging paper required for packaging one roll of the accumulated coins is obtained by varying the position of the cutter from the leading end of the packaging paper, according to the present invention, the desired length of the packaging paper is obtained by varying the operation time of a driving clutch for driving a paper feeding roller to feed the packaging paper or by varying the speed of rotation of the paper feeding roller, hereinafter described in detail.

The packaging paper 7 is adapted to be fed out between feeding rollers 8 and 9, be guided along a guide plate 10, and be introduced into the packaging mechanism c.

Figure 2:
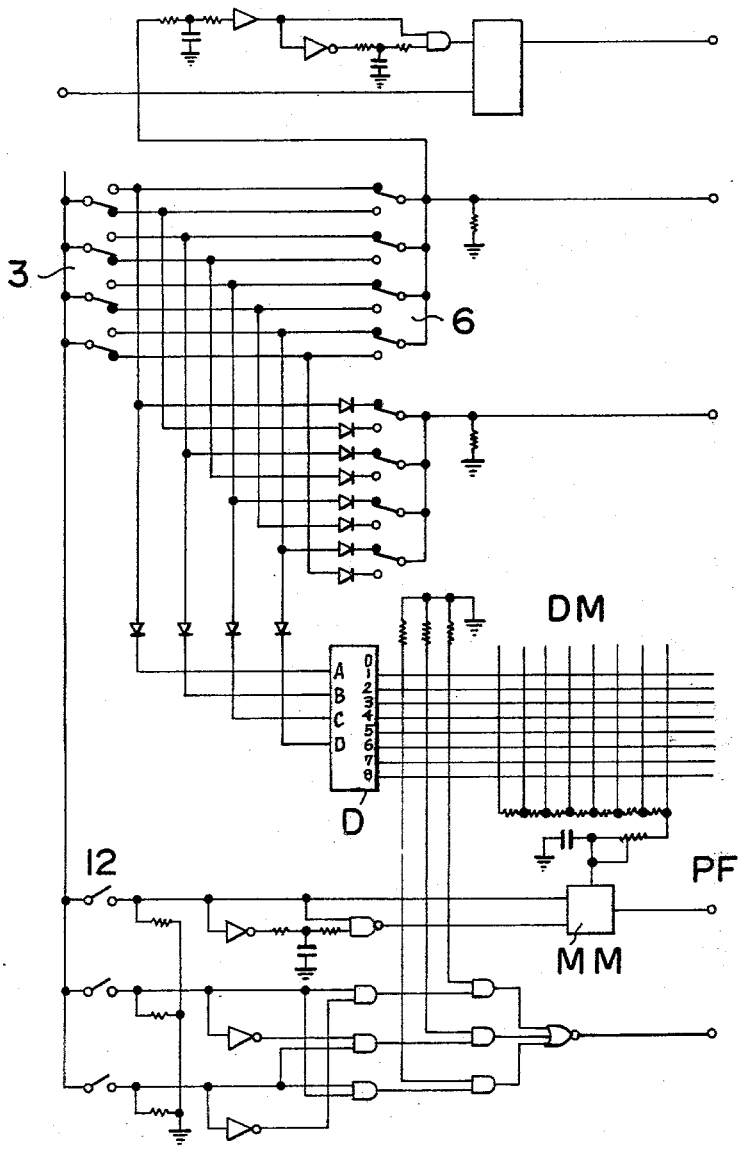
FIG. 2 is a wiring diagram illustrating one embodiment of the electric circuit of the apparatus of the present invention.

As best seen in FIG. 2, a coded signal obtained by the combination of contacts of the selection switches 3 selected by the coin kind setting member 1 is transmitted through a decoder D to a diode matrix DM. In the meantime, a signal is issued by the closing of a paper feed switch 12. The paper feed switch 12 is closed in timed relationship with the packaging operation by a cam provided on a one-revolution cam shaft 11 which actuates a transferring mechanism d, the clamping mechanism e, etc. In the transferring mechanism, the accumulated coins are transferred from the accumulating cylinder to the packaging mechanism. The above-mentioned signal generated by the closing of the paper feed switch 12 and the coded signal transmitted to the diode matrix DM are put together in a monostable multivibrator MM to issue a delay signal at a terminal PF. The speed of rotation of a driving roller 8 or 9 is determined by a clutch, (not shown), operatively associated with the driving roller in accordance with the delayed time of the delay signal put out at the terminal PF. In the event the speed of rotation of the driving roller is constant, the amount of rotation is determined by the clutch in accordance with the delayed time of the delay signal.

We claim:

1. A device for setting the quantity of packaging paper feed for use in a coin packaging machine, comprising:

a group of coin kind selection switches for issuing a coded coin kind selecting signal in accordance with the coin kind set by the coin kind setting operation for the coin to be packaged, decoder means connected to said group of coin kind selection switches for receiving and decoding said coded coin kind selecting signal into a decimal signal and providing said decimal signal as an output, a paper feed switch, a monostable multivibrator having a time constant and being operatively associated with said paper feed switch so as to be triggered by said paper feed switch to issue a delay signal indicating a delay time, and means for applying said decimal signal of said decoder to said monostable multivibrator so as to vary the time constant of said monostable multivibrator and thereby to vary the delay time of said delay signal, whereby the quantity of packaging paper feed is automatically determined in accordance with the delay time of said delay signal.

2. A device as set forth in claim 1, wherein said applying means comprises a diode matrix.

3. A device as set forth in claim 2, wherein at least one feeding roller is provided for feeding the packaging paper, and wherein the quantity of packaging paper feed is varied by the quantity of rotation of the feed roller in accordance with the delay time of the delay signal.

4. A device as set forth in claim 1, wherein at least one feeding roller is provided for feeding the packaging paper, and wherein the quantity of packaging paper feed is varied by the speed of the feed roller in accordance with the delay time of the delay signal.

* * * * *